US005513929A

United States Patent [19]

Calkins et al.

[11] Patent Number: 5,513,929

[45] Date of Patent: May 7, 1996

[54] FIXED OFFSHORE PLATFORM STRUCTURES, USING SMALL DIAMETER, TENSIONED, WELL CASING TIEBACKS

[75] Inventors: Dennis E. Calkins, Thibodeaux, La.; Charles E. Kindel, Houston, Tex.; Robin M. Converse, Houston, Tex.; Roger S. Osborne, Houston, Tex.; James A. Haney, Houston, Tex.; Raymond J. Serpas, Houston, Tex.

[73] Assignee: McDermott International, Inc., Panama

[21] Appl. No.: 289,154

[22] Filed: Aug. 11, 1994

[51] Int. Cl.[6] ..... E21B 43/01

[52] U.S. Cl. ..... 405/195.1; 405/225; 166/367

[58] Field of Search ..... 405/224.2, 195.1, 405/225, 226, 227; 166/356, 367, 368

[56] References Cited

U.S. PATENT DOCUMENTS

| | | | |
|---|---|---|---|
| 3,827,486 | 8/1974 | Hall | 166/368 X |
| 3,861,463 | 1/1975 | Crowe | 166/368 X |
| 4,456,071 | 6/1984 | MIlgram | 166/356 |
| 4,519,724 | 5/1985 | Knowles et al. | 405/195 |
| 4,561,803 | 12/1985 | Campo et al. | 405/195.1 X |
| 4,679,964 | 7/1987 | Blandford | 166/356 X |
| 4,932,811 | 6/1990 | Folding | 405/195.1 X |
| 5,379,844 | 1/1995 | Glasscock et al. | 166/358 |

*Primary Examiner*—Frank Tsay
*Attorney, Agent, or Firm*—R. J. Edwards; D. Neil LaHaye

[57] ABSTRACT

A fixed, non-compliant, non-floating offshore platform subject to lower wave, wind, current, and rig loadings resulting from a configuration that supports the portion of the well casings that extend from near the seafloor to a deck level above the water surface using tension instead of intermediate lateral supports. Only the smallest one or two well casings among all those that comprise the well casing system are extended back from the seafloor, which further reduces the lateral loadings on the structure.

2 Claims, 3 Drawing Sheets

FIXED OFFSHORE PLATFORM STRUCTURES, USING SMALL DIAMETER, TENSIONED, WELL CASING TIEBACKS

BACKGROUND OF THE INVENTION

1. Field of the Invention

The invention is generally related to fixed offshore platform structures and more particularly to configurations of these structures that result when only the smallest one or two well casings are extended back from the seafloor to the platform deck and when these casings are supported in tension.

2. General Background

Each offshore oil and gas well begins with a pipe called a "conductor" that penetrates the ocean floor for several hundred feet. Traditionally, conductors have constant diameters along their lengths, usually from twenty-four to thirty inches. The conductor often extends from the sea floor back to the platform's deck level. However, when the well is drilled from a floating vessel, the conductor extends only five to ten feet above the sea floor. The primary function of the conductor is to provide a support foundation for the weight of the well components during drilling. For conductors extended back to the deck level, it has the additional functions of supporting and protecting the well casings in the water and air zones between the rig and the sea floor. The rest of the well consists of a hole lined with a series of concentric steel pipes called "casings" where each casing is smaller in diameter and extends deeper below the sea floor than the preceding one until the last and smallest diameter casing reaches from the top of the well to the oil and gas bearing formation. A typical well might have, in addition to the conductor, casings with diameters of twenty inches, thirteen inches, nine and five-eighth inches, and possibly a seven and five-eighth inch casing.

The well is started by drilling a hole that is smaller than the inside diameter of the conductor but larger than the diameter of the first casing. When this first hole has reached its planned depth, usually in the range of two thousand feet below the sea floor, the first casing is assembled from sections and lowered into the hole until it nearly reaches the bottom. The casing is suspended from the top of the conductor and grouted to the soil up to the bottom of the conductor and then to the inside of the conductor up to at least the sea floor. Each successive casing is installed similarly with each one grouted to the soil and to the previous casing up to at least the sea floor. To complete the well, production tubing is run, the production zone containing the oil and gas is isolated, and the formation perforated through the casing to allow the hydrocarbons to flow into the tubing and up to the platform.

The portion of a conductor that extends between the mudline and the platform deck must be able to resist the horizontal loads applied by the offshore environment of waves, current, and wind. Since the distance from the mudline to the deck is usually significantly greater than the conductor can span as an unsupported, side loaded column, the conductors are supported at appropriate levels in the fixed platform by passing through sleeves which are framed into the structure. The sleeves deliver the horizontal loads imposed on the conductors to the platform's major framing elements. These loads are significant in the design of an offshore fixed platform.

Offshore wells can be drilled either by a rig supported from the platform itself, called a "platform rig", or by a rig that does not use the platform structure for support. The platform rig is composed of multiple modules that are lifted onto the platform by either a crane on the platform or by a large floating derrick and then hooked together. This type of drilling rig applies a large loading to the platform due to its weight and wind area. These loadings contribute significantly to the cost of the platform. This approach is generally used where a sufficiently large group of wells, usually nine or more, will be supported by one platform.

To drill an offshore well without supporting the rig with the platform, either a bottom founded, self-elevating rig called a "jack-up", or a floating rig can be used. With a few exceptions, the jack-up is generally designed for water depths up to three hundred feet while the floating rigs can drill in three hundred feet to over ten thousand feet of water. For both types of drilling, the structure still supports the wells as described above and additionally described below, but, by not supporting the drilling rig, the platform structure can be lighter and more economical.

As originally practiced, the jack-up rig positioned itself alongside a previously installed platform, located its derrick over a conductor, and drilled each well in succession using the same technology as the platform rig. Later, well drilling techniques and casing hardware called "mudline suspension and tieback systems" were developed which allowed the jack-up rig to drill the well prior to the installation of the platform and then temporarily disconnect the sections of conductor and casing between the sea floor and the surface and leave the site. The technique has the distinct advantage of allowing the platform fabrication and drilling operations to proceed simultaneously. By adding a subsea wellhead to the mudline suspension and tieback systems, floating rigs can also drill the wells in advance and then disconnect and leave before the platform is installed.

Once the platform is installed, the tieback hardware allows the well casings to be reconnected at the sea floor and extended back to the platform deck. This is most economically done with a platform type rig called a "workover/tieback" rig. These rigs are smaller than a full drilling rig since they only have to support the casing down to the mudline. In these cases, the conductor itself may or may not be extended back to the deck. However, it is the practice to extend at least the first casing plus one, if not all, of the smaller diameter casings back to the deck. This means that the platform structure still has to support a rig of some intermediate size as well as support the horizontal, environmental loadings imposed on the large diameter casings by the waves, current, and wind.

With the development of fields in waters beyond the economical reach of fixed platforms, floating platform concepts were developed, particularly the Tension Leg Platform(TLP) and the Spar Platform(Spar). A TLP is a semi-submersible vessel held on station by tendons that are tensioned against a foundation at the sea floor and the buoyancy of the vessel at the surface. The SPAR is a floating, vertical cylinder, catenary moored on location. These configurations presented efficient systems of platform support in very deep water but there was no structural system available between the floating platform and the sea floor to provide lateral support for the tied back well casings at intervals along their lengths.

A two-part solution was developed to provide this support. First, each tied back casing is tensioned sufficiently to eliminate the need for intermediate lateral support on both types of floating systems. On the TLP, since the vessel moves laterally a large amount and vertically by a smaller but still significant amount, a constant tension is maintained on each casing with a complex mechanical device called a "tensioner". On the SPAR, this tension is maintained by dedicated buoyancy tanks attached to each casing. Second, for both systems, only the smallest (or perhaps the two smallest) casing string is tied back. Generally, this will be the last one (the nine and five-eighth inch casing) instead of the first one (the twenty inch casing), described earlier for fixed platforms. The smaller casing is lighter and offers a much smaller profile to the wave forces. This in turn requires much less tension to support both the casing's weight and its lateral loadings.

From work on TLPs, Spars, and other floating concepts, appropriate design procedures have been developed for tensioned, tied back casing strings, commonly called "tensioned production risers". Tensioned riser design and construction is well understood by those practiced in the art. In addition, the necessary hardware, including the tensioners and the mudline suspension and tieback systems, is well developed and commercially available.

The tensioned riser concept has most recently been applied to Compliant Tower Platforms which are a type of offshore structure distinct from either fixed platforms or floating platforms such as TLPs and Spars. A compliant tower using the tensioned riser concept has been developed by Smolinski, Morrison, Hute, and Marshall and is described in Paper Number 7450 of the 1994 Offshore Technology Conference(OTC).

The highly specialized nature of the offshore fixed platform industry has presented problems in improving the technology used. It is Well known to offshore platform designers that the well conductors above the seabed contribute a major portion of the total environmental loading on the platform (typically twenty to 30 percent). However, since the platform design engineers have historically executed their designs using specific criteria provided by the drilling and production specialists of the oil companies, the platform designer did not need to know much about drilling technology in order to execute a competent and safe design. The oil companies are further specialized between those who procure the platforms and those who direct the drilling and reservoir development. The natural communication gaps caused by the specialization in the industry has inhibited development of more efficient arrangements.

SUMMARY OF THE INVENTION

The present invention addresses the above problems in the form of a novel application of existing well tieback technology to the group of offshore structures referred to as "fixed platforms", which herein is intended to include all variations of bottom founded, non-compliant, piled or gravity type offshore structures, e.g. traditional steel template platforms, minimal platforms, caissons, braced caissons, braced drive pipes; and taut-guyed, non-compliant towers, caissons and drive pipes. This tieback technology was first developed for use with Tension Leg Platforms(TLPs) then applied to Compliant Tower platforms and, with this invention is now applied to fixed platforms.

Wells using this tieback technology which are to be supported by fixed platforms will be drilled using mudline suspension and tieback system hardware. They either will be drilled in advance and the platform installed later or drilled from the platform. In either case, only the one or two smallest casing strings would be tied back to the deck of the fixed platform. Several different casing tieback combinations can be selected but each one is a variation on the same idea; namely, to minimize each well's contribution to the total loading applied to the fixed platform by: 1) minimizing the diameter of the largest casing string exposed to environmental loads, 2) minimizing the amount of structure required to laterally support the casings and, 3) minimizing the size of the equipment(rig) needed to effect the tieback operation.

There are three principle advantages from minimizing the diameter of the largest casing string tied back. First, the total horizontal load applied to the fixed platform's structural system is significantly reduced, thereby reducing the amount and cost of the structure needed to carry this portion of the loading. Second, the cost of the additional casing strings that would have been tied back in the prior art is eliminated. Third, tying back only the smaller casing diameter(s), compared to larger diameter(s) used in the prior art of fixed platforms, permits a much smaller and lighter workover/tieback rig to perform the tieback operation. Not only will the smaller rig result in a lighter, more economical platform but the cost to rent, transport, and operate the smaller workover rig will be lower than a larger workover rig.

The major advantage to supporting the casings in tension instead of using conventional lateral supports is that it eliminates the need for structural framing included solely for this purpose, such as: horizontal framing members, casing guides and casing guide supports. Eliminating this framing eliminates not only its fabrication cost but also the waveload this framing adds to the entire structure.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
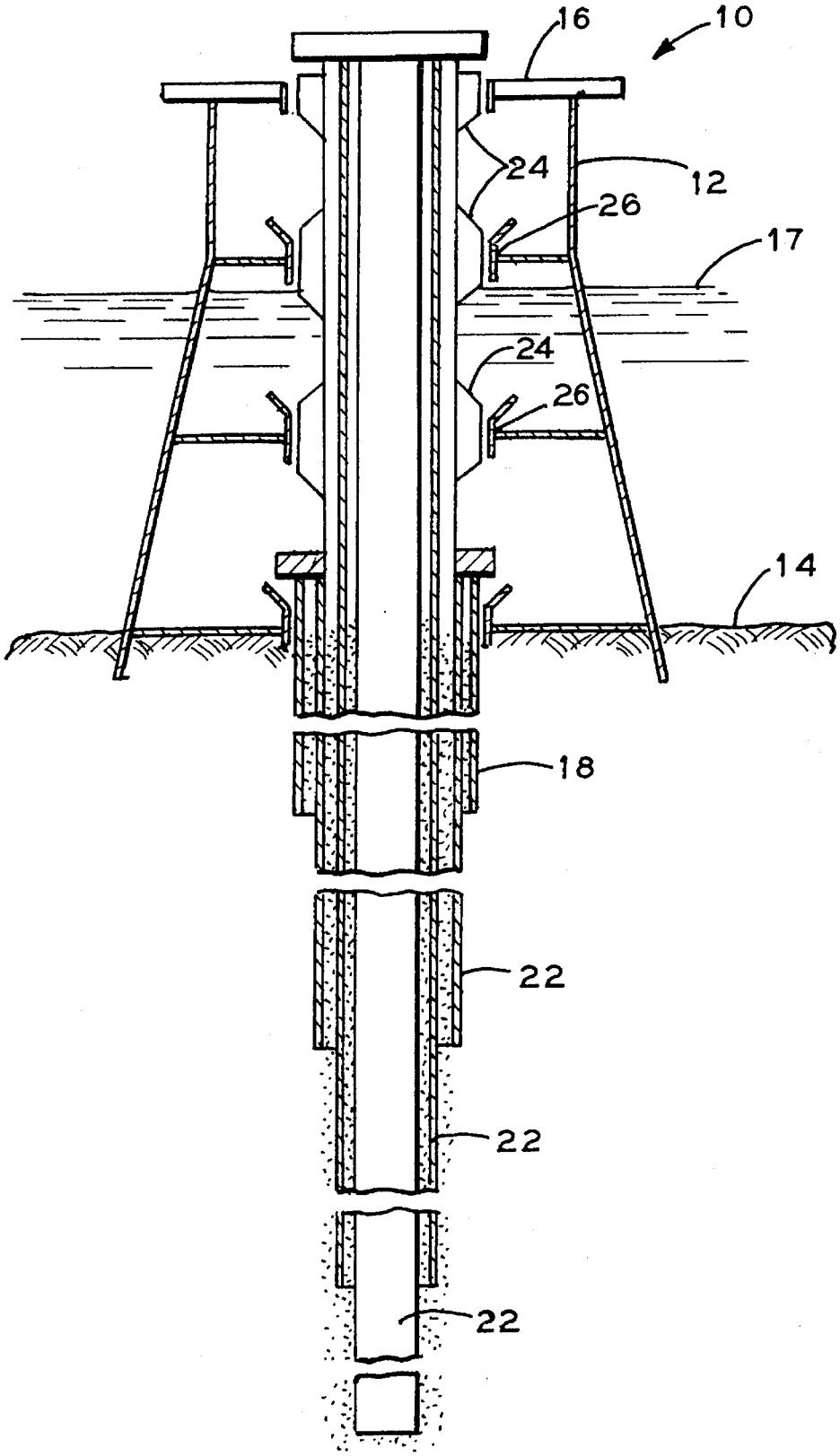
FIG. 1 is a side sectional view of a conventional tieback arrangement for a fixed offshore platform.

Referring to the drawings, FIG. 1 illustrates a conventional well tieback arrangement for a fixed offshore platform. Fixed offshore platform structure 10 is formed from a jacket or support structure 12 that is supported on seabed 14. Deck 16 is attached to and supported above the water line 17 by support structure 12. Conductor 18 penetrates the seabed 14 a predetermined distance to vertically support the well. A plurality of concentric casings 22 penetrate the seabed in the well to various depths. Casings 22 are cemented or grouted to the soil, to each other and to conductor 18 to a level above the seabed in a manner known in the art. All of casings 22 extend above the grouting level and above the water line to deck 16. Lateral support between the seabed and deck is provided in the form of casing centralizers 24 and horizontal support framing members 26 attached to support structure 12 and deck 16.

Figure 2:
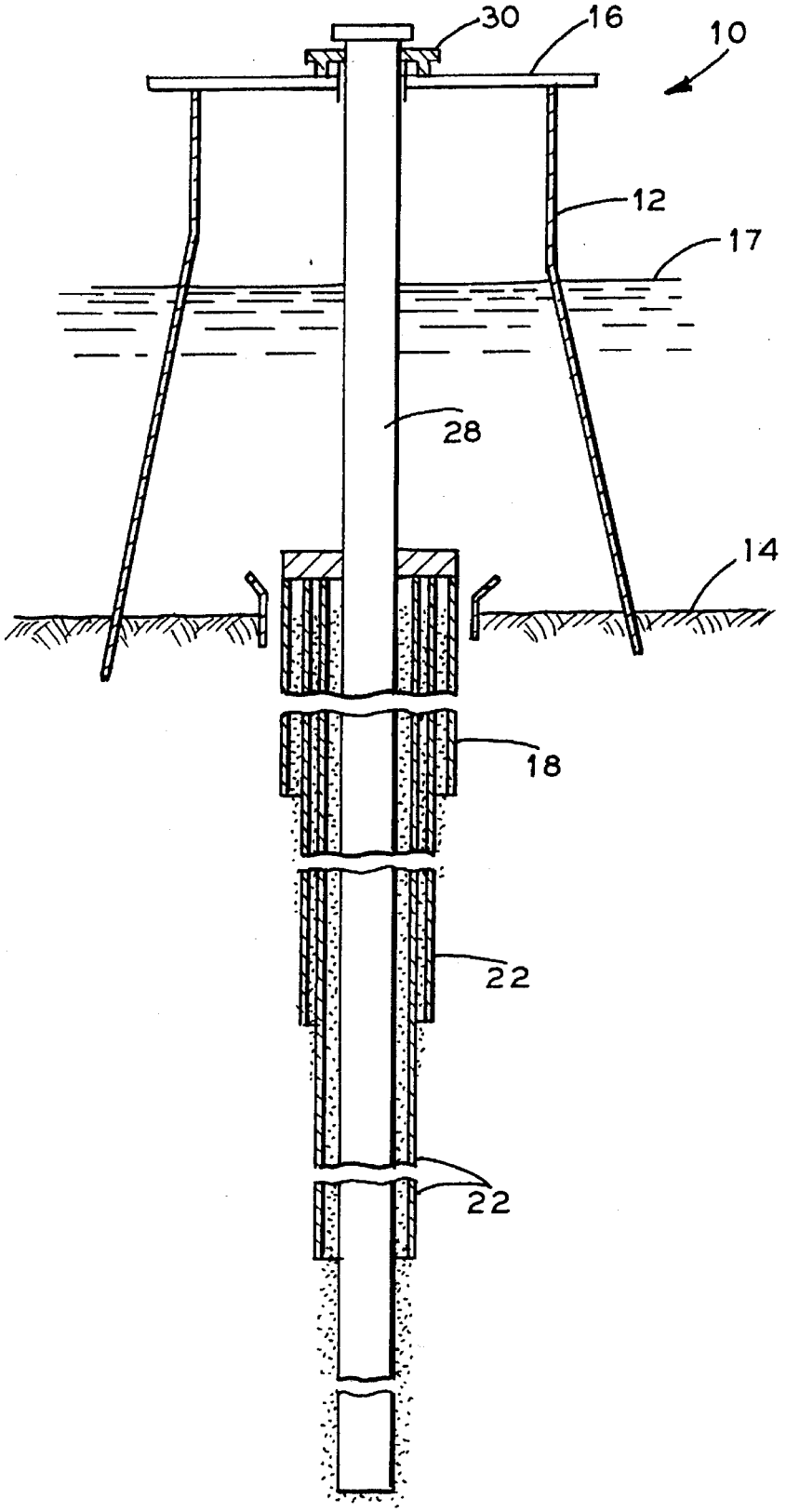
FIG. 2 is a side sectional view of the tieback arrangement of the invention.

The present invention, illustrated in FIG. 2, both reduces the wave loading from the casings themselves and eliminates the need for the conventional lateral support of the well casings seen in FIG. 1. The casings 22 and conductor 18 are grouted together in the portion of the well from immediately above the seabed down to the reservoir. However, only the smallest of the casings, as indicated by the numeral 28, extends beyond the grouting level in the conductor near the seabed to the fixed offshore platform deck 16. Casing 28 is supported at or below the deck 16 by a support device 30 as illustrated. Casing 28 is supported in sufficient tension to eliminate the need for the lateral support provided by casing centralizers 24 and framing members 26 seen in FIG. 1. Eliminating these framing members eliminates both the weight of the members themselves and the portion of the total waveload on the structure which would have been contributed by these members. Since the in-service fixed platform has very small lateral excursions and negligible vertical movement, neither tensioners, as described for TLPs, nor special buoyancy tanks, as described for Spars, are required to support the tied back casing. Thus, expensive and high maintenance equipment is replaced by the relatively inexpensive equipment 30 required to provide a sustained tension to casing 28 at deck 16.

An example of an embodiment of the fixed offshore platform that takes full advantage of the invention is a tripod configuration of a template type structure. Unlike a structure with four or more legs, a tripod platform with its three legs and interconnecting framing in the vertical truss rows is naturally triangulated and stable without any additional framing in the horizontal planes. In the prior art, additional horizontal framing is required for the sole purpose of supporting the well conductors and casings. This invention eliminates the need for adding this horizontal framing to these tripods thereby maximizing the efficiency of the structural framework.

In developing the invention through comparative structural analyses of a tripod application the results of the analyses for the designs that used the idea were unexpectedly good. By eliminating the need for casing support framing between the seafloor and the platform deck, it was found that this not only eliminated the support guides and their supporting structure but it was also possible to eliminate all horizontal framing of any type at nearly every level in the structure. The direct savings in steel weight from the members that were eliminated, combined with the reduced steel weight in the remaining members due to the reduced loadings, significantly exceeded expectations, not in the nature of the savings but in the amount of the savings. For example, the design of a tripod platform for one thousand feet of water with six wells that did not use the invention compares with both expected weights and the actual analysis based weights for a design which did take full advantage of the invention, as follows:

| | |
|---|---|
| Conventional design using laterally supported tiebacks | 11,000 short tons |
| Expected design results using tensioned tieback invention | 9,500 short tons |
| Actual design results using tensioned tieback invention | 7,200 short tons |

In the course of refining the tripod design using the invention, it was found that each design iteration resulted in further steel weight reductions as other elements which normally contribute to the platform loading were also reduced along with the reductions in the basic framing. These included reductions in anodes with savings in both weight and waveload and reductions in marine growth with savings in waveload. As the weight iterated lower and lower with further analysis, the jacket became light enough to install offshore by lifting in one piece using available floating marine equipment. This eliminated the need for either launch truss framing (fifteen to twenty percent of the total jacket weight) or the extra expense of installing the platform jacket in two pieces instead of one.

Figure 3:
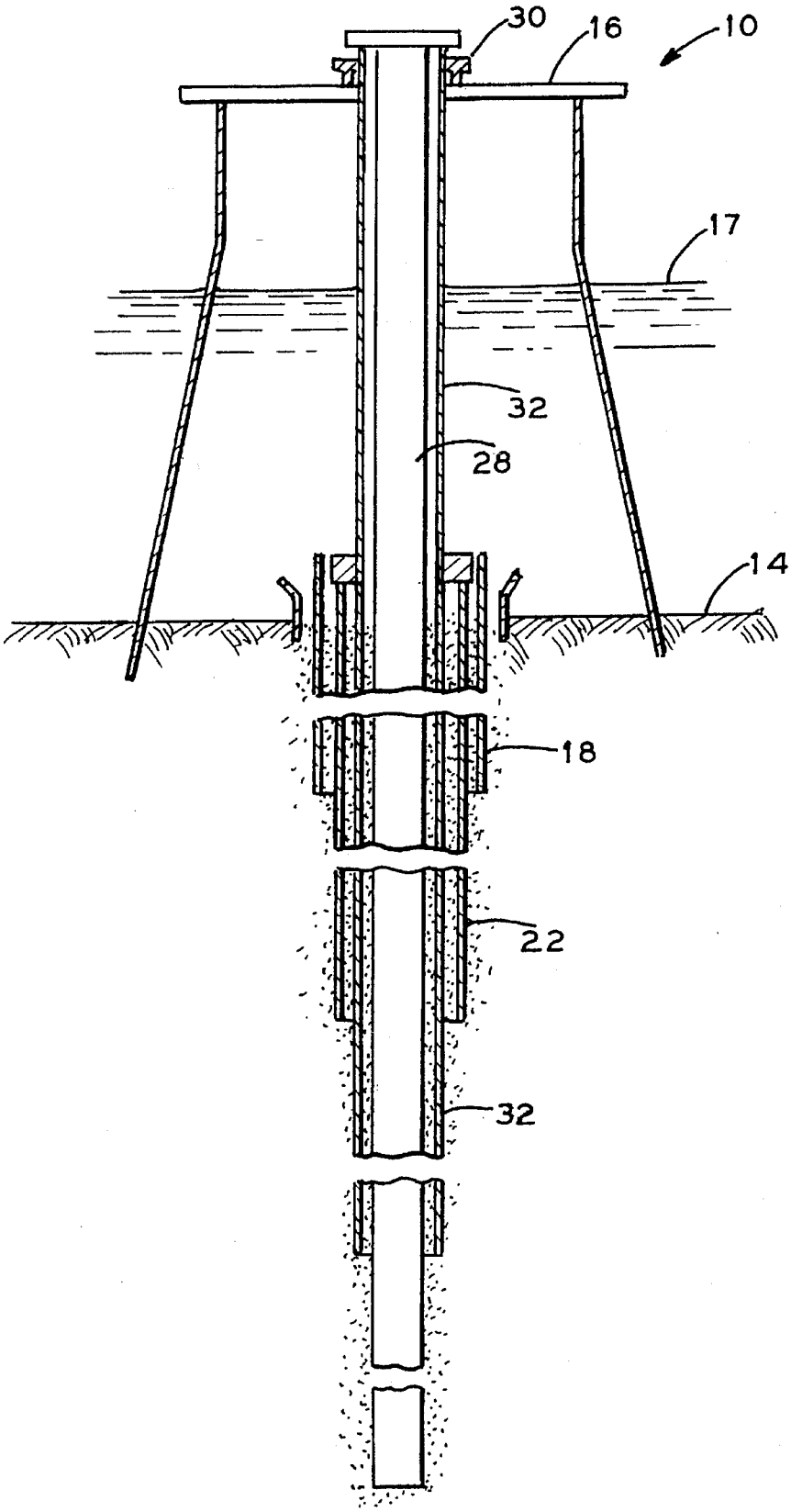
FIG. 3 is a side sectional view of an alternate embodiment of the invention.

FIG. 3 illustrates an alternate embodiment of the invention wherein two of casings 22, the smallest and second smallest casings as indicated by numerals 28 and 32, are maintained in tension by support device 30. This provides for the situation where well completion and reservoir design make it preferable to have the additional conduit between the deck 16 and the wellhead near the mudline.

Another alternate embodiment is to provide a combination of conventional lateral support and tension to support the smallest one or two casing strings.

Another alternate embodiment is to provide lateral support of the smallest one or two casings as a group using a spine or other member with casing supports located at such close intervals that tension is not required.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a fixed, non-compliant, non-floating offshore platform structure having a support structure attached to the seabed, a deck supported above the water line by the support structure, a conductor that penetrates the seabed, and a plurality of concentric well casings that extend inside the conductor below and above the seabed, an improved platform configuration using a well casing tieback arrangement comprising:

a. the well casings being grouted to the seabed, to each other and the conductor up to a level immediately above the seabed;

b. only the smallest of the well casings extending above the level of grouting up to the offshore platform structure above the water line; and c. said smallest of the well casings being supported in tension by the offshore platform structure whereby lateral support of said smallest casing by the offshore platform structure between the deck above the water line and the seabed is unnecessary.

2. In a fixed, non-compliant, non-floating offshore platform structure having a support structure attached to the seabed, a deck supported above the water line by the support structure, a conductor that penetrates the seabed, and a plurality of concentric well casings that extend inside the conductor below and above the seabed, an improved platform configuration using a well casing tieback arrangement comprising:

a. said well casings being grouted to the seabed, to each other and the conductor up to a level immediately above the seabed;

b. only the smallest two of the well casings extending above the level of grouting up to the offshore platform structure above the water line; and c. said two smallest of the well casings being supported in tension by the offshore platform structure whereby lateral support of said two smallest casings by the offshore platform structure between the deck above the water line and the seabed is unnecessary.

* * * * *